United States Patent [19]

Bollmann

[11] 4,252,477

[45] Feb. 24, 1981

[54] MINE ROOF SUPPORT

[75] Inventor: Alfred Bollmann, Bochum, Fed. Rep. of Germany

[73] Assignee: Bochumer Eisenhütte Heintzmann GmbH & Co., Bochum, Fed. Rep. of Germany

[21] Appl. No.: 62,898

[22] Filed: Aug. 1, 1979

[30] Foreign Application Priority Data

Oct. 7, 1978 [DE] Fed. Rep. of Germany ..... 2843857

[51] Int. Cl.[3] ..... E21D 15/44

[52] U.S. Cl. ..... 405/296; 405/295

[58] Field of Search ..... 405/291, 295, 296; 299/33

[56] References Cited

U.S. PATENT DOCUMENTS

| | | | |
|---|---|---|---|
| 3,854,293 | 12/1974 | Spies | 405/296 X |
| 3,874,178 | 4/1975 | Kunzer | 405/296 X |
| 3,885,396 | 5/1975 | Snowden et al. | 405/296 |
| 4,056,941 | 11/1977 | Watermann | 405/296 |

FOREIGN PATENT DOCUMENTS

| | | | |
|---|---|---|---|
| 612044 | 6/1978 | U.S.S.R. | 405/295 |

*Primary Examiner*—David H. Corbin
*Attorney, Agent, or Firm*—Michael J. Striker

[57] ABSTRACT

A mine roof support has a base and a roof shield pivoted to the base and carrying at its upper end a pivoted cap which is urged upwardly against the mine roof by a hydraulic pit prop reacting between the cap and the base. The lower end of the roof shield is connected to the base by two links each having a pivot cooperating with a pivot on the roof shield, and a pivot cooperating with a pivot on the base. In addition, the base and/or the lower end of the roof shield has an auxiliary for each link and each link has an auxiliary pivot which can be connected with one of the auxiliary pivots of the base or lower end.

7 Claims, 3 Drawing Figures

MINE ROOF SUPPORT

BACKGROUND OF THE INVENTION

The present invention relates to mine roof supports, and more particularly to the type of mine roof support with a vertically adjustable roof shield.

Mine roof supports of this type are already known in general. They have a base on which a roof shield is pivoted, the upper end of the shield being provided with a cap that is pressed by a hydraulic pit prop against the roof of the mine gallery or the like. A free edge of the cap is, in operation of the support, so positioned that it is close to the mine face so that the workers and equipment beneath the cap are protected against break-in of the roof of the gallery. An advantage of this type of mine roof support is the fact that the shield together with the mounting arrangement, the base and the pit prop forms in effect a four-bar linkage, a construction which assures that over a certain height of the mine gallery the roof cap can be adjusted vertically in such a manner that its front edge adjacent the mine face itself moves in an almost completely vertical path and thus can always remain adjacent the mine face and provide proper security for the personnel working below it. However, this vertical adjustment range is limited, i.e. if the vertical height of a coal seam requires the mining gallery to be higher than a predetermined limit, further upward adjustment of the roof cap is either not possible or, if it can be done, causes the front edge of the roof cap to move rearwardly away from the mine face leaving a portion of the mine roof unsupported. The reason for this has to do with the particularities of supporting underground passages, in particular the required or desired inclination of the roof shield and the distance at which the lower end of the shield proximal to the base must be spaced from that end of the base which is distal from the mine face. The roof shield must not be inclined at too flat an angle to the vertical because otherwise forces acting upon it from the roof and the overhang will negatively influence the supporting capability of the mine roof support. Also, when the roof shield is retracted to a relatively low position, the lower end of the roof shield must not project too far beyond that end of the base which faces away from the mine face, because otherwise the thus projecting lower end would conflict with rubble which drops into the goaf and readjustments of the roof shield would become difficult or impossible because of the presence of such rubble. In such an event, also, the linkages connecting the roof shield to the base, and the journals for the linkages, would be subjected to excessively high stresses.

Theoretically it would be possible to increase the height over which the front edge of the roof cap can be adjusted in a substantially vertical path, by reconstructing the mine roof support with respect to the length of the linkages and of the roof shield, as well as with respect to the position at which the linkage are connected to the roof shield and to the base. However, if this is done then necessarily the roof shield and the linkages must be increased in size and this, in turn, means that when the roof shield is lowered to a position in which it is relatively close to the face, it will project rearwardly so far into the goaf that its subsequent readjustment will be most disadvantageously influenced, for the reasons explained above. Also, if the mine gallery is of relatively small height a so reconstructed mine roof support would necessarily have its roof shield inclined at so flat an angle to the vertical that the other disadvantages outlined above would inherently result.

To avoid these problems mine roof supports of the type in question, i.e. having a four-bar linkage construction, heretofore have been designed so that they can operate within a predetermined limited mine gallery height. Within this predetermined limited height the disadvantages outlined above can be eliminated. These supports could not, however, be used if the mine gallery height was greater than the predetermined limited height unless one was prepared to accept the aforementioned disadvantages.

SUMMARY OF THE INVENTION

Accordingly, it is an object of the present invention to avoid the disadvantages of the prior art.

More particularly, it is an object of this invention to provide an improved mine roof support of the type in question which avoids the aforementioned disadvantages and can be used to support the roof of mine galleries having a height which is substantially greater than those in which this type of mine roof support could previously be used, i.e. a height which is at least twice as great than the conventional height.

In keeping with these objects, and with others which will become apparent hereafter, one aspect of the invention resides in a mine roof support which, briefly stated, comprises a base having a first end section and a second end section which are adapted to be proximal to and distal from a mine face, respectively. A roof shield is provided, including an upright having a lower and an upper end section, and a roof cap above the base and pivoted to the upper end section. A pit prop reacts between the roof cap and the base. A pair of links connect the lower end section to the second end section of the base. Two pair of first pivot bearings are provided in the lower end section and the base, respectively, and a pair of second pivot bearings is provided in each of the links and are each adapted to pivotally cooperate with one of the pairs of first pivot bearings. At least one auxiliary pivot bearing is provided in each of the links and at least two auxiliary pivot bearings are provided in at least one of the second and lower end sections, respectively, and adapted to cooperate with the auxiliary pivot bearings in the links.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
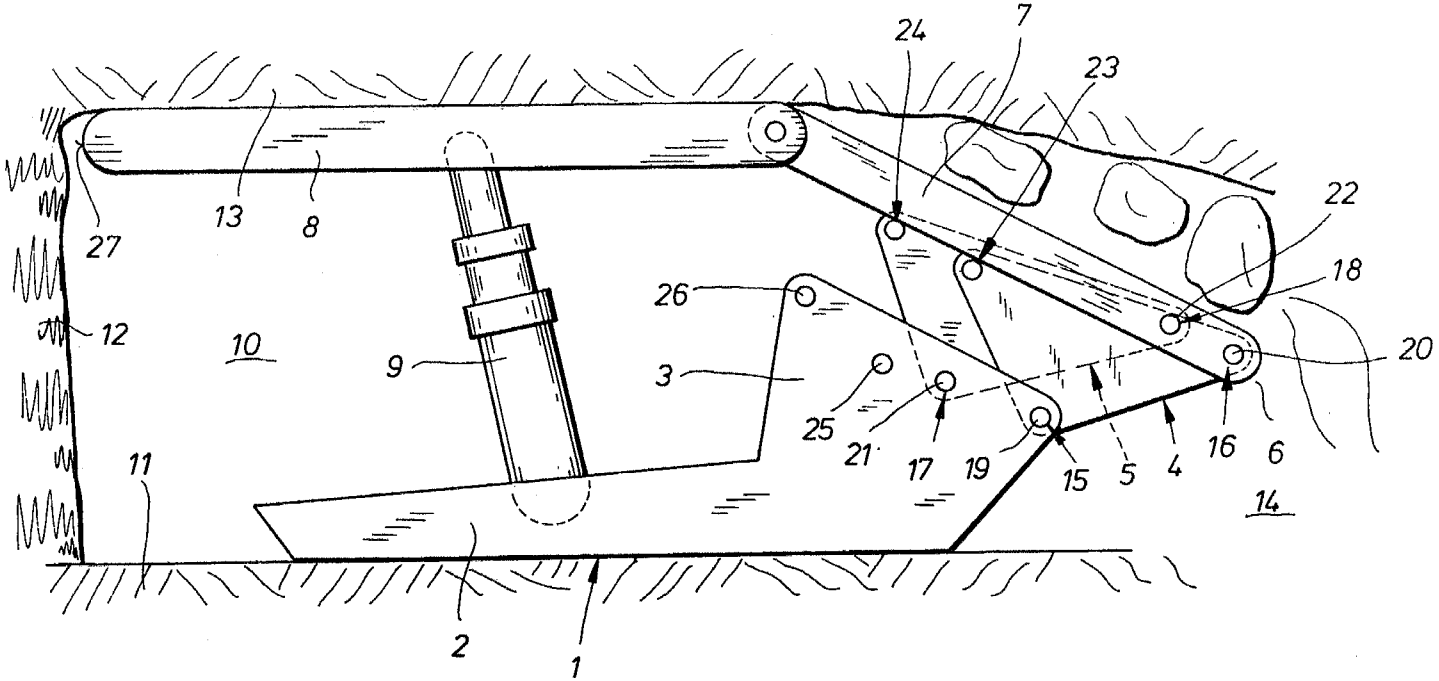
FIG. 1 is a somewhat diagrammatic side view illustrating a mine roof support according to the present invention installed in a mine gallery of low height.
Figure 2:
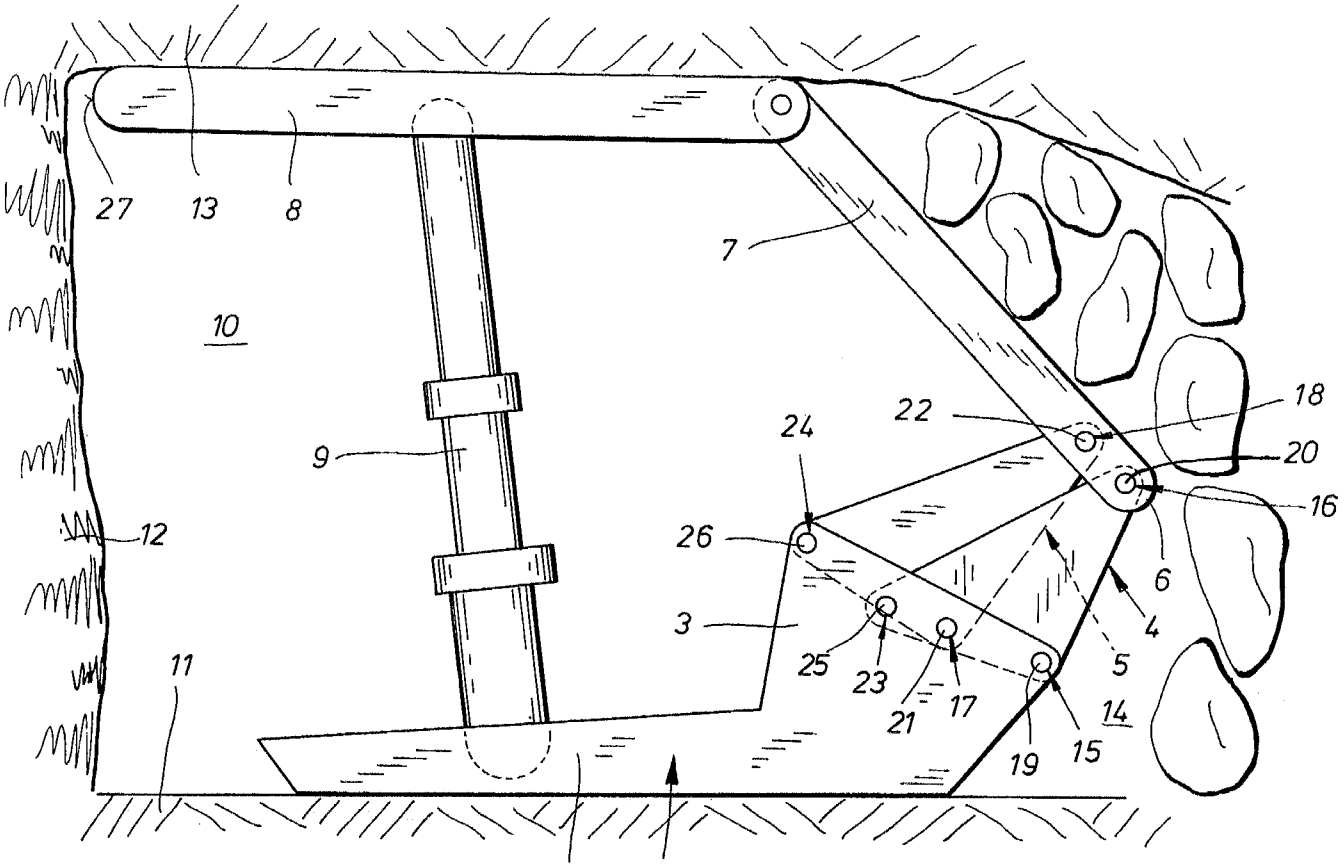
FIG. 2 shows the mine roof support of FIG. 1 installed in a mine gallery of medium height.
Figure 3:
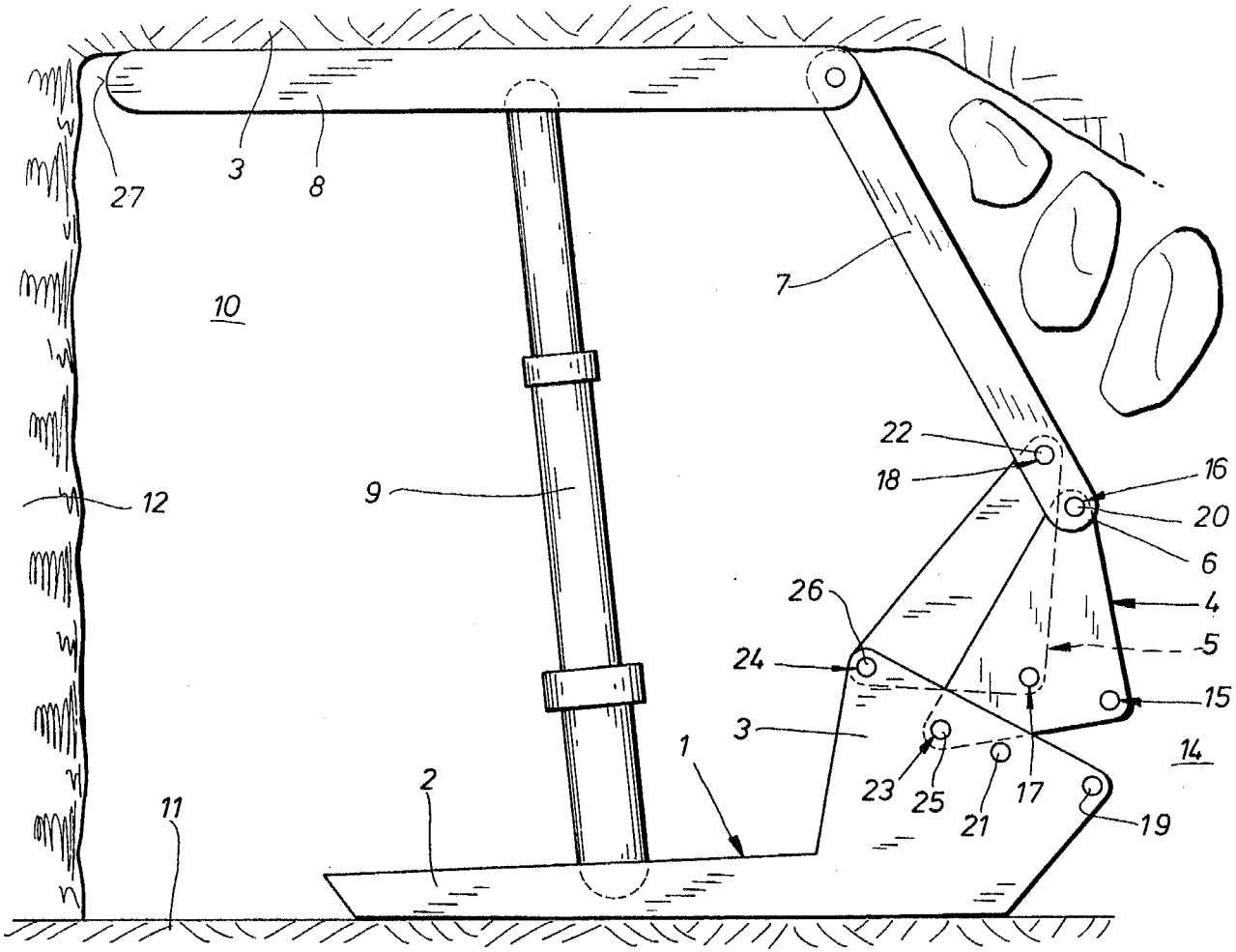
FIG. 3 illustrates the same mine roof support of FIGS. 1 and 2, but installed in a mine gallery of greater height.

A mine roof support according to the present invention is illustrated in FIGS. 1–3 in a single embodiment, but installed in mine galleries of different heights. The reference numerals used in all three Figures are therefore identical.

The mine roof support is identified with reference numeral 1 and has a base 2 which may be of one piece or of several pieces. The end 3 of the base which faces the goaf, i.e. faces away from the mine face 12, is raised upwardly and serves for the pivotal mounting of two links 4, 5 which are of plate-shaped configuration and which are also pivotally connected with the lower end section 6 of a roof shield 7 which may also be of one or more parts. A roof cap 8 is pivoted to the upper end of the roof shield 7 and is supported by a telescopable hydraulic pit prop 9 which reacts between the cap 8 and the base 2. The latter is supported on the floor 11 of the mine gallery 10. It will be appreciated that more than two of the links 4, 5 may be present, for example two pair or several pair of them.

In all Figures the floor is identified with reference numeral 11, the ceiling with reference numeral 13, the mine gallery with reference numeral 10, the mine face with reference numeral 12 and the goaf with reference numeral 14.

In the illustrated embodiment the links 4, 5 are of approximately triangular shape and are each provided with two pivot bearings 15, 16 and 17, 18 for connection with the pivot bearings 19, 20 and 21, 22 of the base 2 and the roof shield 7, respectively. The term "bearing" here may simply imply holes through which appropriate bolts (not shown) may be placed. The links 4 and 5 are each also provided with an auxiliary pivot bearing 23 and 24, respectively, which is offset in the plane of pivoting of the links 4, 5 with reference to the pivot bearings 15, 16 and 17, 18. The spacing of the pivot bearings 15, 16 and 17, 18 from one another, displacing of the pivot bearing 16 from the auxiliary bearing 23 and of the pivot bearing 18 from the auxiliary bearing 24, and the spacing of the pivot bearing 15 and 17 from the auxiliary bearings 23 and 24, respectively, is on the order of about 4:5:3.

The end portion 3 of the base 2 is provided, in addition to the pivot bearings 19 and 21 for the links 4 and 5, with two auxiliary pivot bearings 25 and 26 which are offset in direction towards the mine face 12 and in direction towards the mine roof 13 with reference to the pivot bearings 19 and 21. The spacing of the pivot bearings 25, 26 from the pivot bearings 19, 21 corresponds to the distance of the pivot bearings 15, 17 from the pivot bearings 23, 24, respectively.

FIG. 1 shows the mine roof support 1 installed in a mine gallery 10 of low height, i.e. a mine gallery which is provided in a coal seam of low height, low height being assumed here to be about 2.50 meters. The pit prop 9 is telescoped together and the links 4, 5 have their pivot bearings 15 and 17 connected to the pivot bearings 19 and 21, respectively. The line of connection of the pivot bearings 16, 18 relative to the auxiliary pivot bearings 23, 24 is only slightly inclined with reference to the roof shield 7.

If, however, the height of the coal seam (and hence the height of the mine gallery 10) increases to say 3.60 meters, as shown in FIG. 2, then the pit prop 9 is telescoped apart as shown, and this causes the links 4, 5 to pivot about the pivot bearings 19, 21 in direction towards the mine face 12. The lower end portion 6 of the roof shield 7 moves in an arc about the pivot bearing 19 in upward direction, and the front end 27 of the roof cap 8 moves in an almost straight vertical path in upward direction. The links 4, 5 continue to be connected with the pivot bearings 19, 21. Because of the construction of the mine roof support it would be possible to telescope the pit prop 9 apart to a slightly greater degree than is shown in FIG. 2, and the front end 27 of the roof cap 8 would still move in an essentially straight vertical line in upward direction. However, this degree of additional movement is very limited and very shortly thereafter the front end 27 would, during continued upward movement of the roof cap 8, begin to recede in direction away from the mine face 12.

This is avoided in accordance with the present invention. If, for example, the mine roof support is to be used in a mine gallery 10 of still greater height than shown in FIG. 2, of e.g. 4.50 meters, then as shown in FIG. 3 the connection between the links and the base 2 is changed. This is done by extending the hydraulic pit prop 9 to such an extent that, as shown in FIG. 2, the auxiliary pivot bearings 23, 24 become aligned with the auxiliary pivot bearings 25, 26 and via these now aligned auxiliary pivot bearings the links 4, 5 and the base 2 are connected, e.g. by inserting both through the aligned pivot bearings and securing them. Thereafter, the connections between the pivot bearings 15, 17 and 19, 21 are severed, e.g. by withdrawing bolts previously extending through them, and further telescoping-apart of the pit prop 9 will now cause the links 4, 5 to pivot about the pivot bearings 25, 26. This makes it possible for the roof cap 8 to continue in a straight vertical line in upward direction, with its front end 27 remaining closing adjacent to the mine face 12, even in a high mining gallery 10 as shown in FIG. 3.

This construction thus permits the mine roof support to be changed over for use in mine galleries of considerable height without having to change the length or size of the links 4, 5 and/or of the roof shield 7, and in fact without making any other structural changes in the mine roof support at all. Nevertheless, the front end 27 of the roof cap 8 can now be moved in a vertical line in which it remains closely adjacent to the mine face 12 at all times, through a much greater vertical height than was previously possible. Of course, the auxiliary pivot bearings could be provided in the lower end section 6 of the roof shield 7, instead of in the portion 3 of the base 2, or such auxiliary pivot bearings could be provided both in the portion 3 and the lower end section 6.

It is a particular advantage of the invention that during changeover of the mine roof support from operation in tall mining galleries as shown in FIG. 3 to intermediate and low mining galleries as shown in FIGS. 2 and 1, or vice versa, no additional equipment is needed to support the roof during the changeover. Also, no additional equipment is needed to support any parts of the mine roof support itself during changeover since all parts remain coupled with one another in their previous operating mode until the readjustment has been made at which point the device is immediately ready for operating in the second operating range, i.e. in the higher-gallery range or in the lower-gallery range, as the case may be. Another advantage of the support according to the present invention is that the roof shield 7 can always be maintained at an angle of inclination in which the roof shield is not excessively loaded by rock dropping into the goaf. Furthermore, the lower end section 6 of the roof shield 7 can be kept relatively close to the end portion 3 of the base 2, even in a mine gallery of low height (see FIG. 1) so that no disadvantageous forces will act upon the mine roof support, for example by engagement of the lower end section 6 of the roof shield 7 on rubble dropping into the goaf.

The links 4, 5 need of course not be plate shaped, nor do they need to be generally triangular. However, this is an advantageous embodiment as opposed to the usual strap-shaped type of link, because the expense of manufacturing plate-shaped links of this type is only insignificantly greater but substantially facilitates the positioning of the auxiliary pivot bearings. Moreover, by having the pivot bearings and auxiliary pivot bearings arranged in a triangular pattern differential distances of the pivot bearings and auxiliary pivot bearings from one another can be chosen which make it possible to increase the original distance through which the front end 27 of the roof cap 8 can be vertically moved in a straight line, to double the original distance or even to a multiple of the original distance. The offsetting of the auxiliary pivot bearings in the portion 3 of the base 2 towards the mine face and towards the mine roof 13 with reference to the pivot bearings 19, 21 in the portion 3, makes it possible very precisely select the extent and degree of vertical movement of the end portion 27 of the roof cap 8 without having it recede in direction away from the mine face 12.

While the invention has been illustrated and described as embodied in a mine roof support, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt if for various applications without omitting features, that, from the standpoint of prior art, fairly constitute essential characteristics of the generic or specific aspects of this invention.

What is claimed as new and desired to be protected by Letters Patent is set forth in the appended claims:

1. A mine roof support, comprising a base having a first end section and a second end section which are adapted to be proximal to and distal from a mine face, respectively; a roof shield, comprising an upright having a lower and an upper end section, and a roof cap above said base and pivoted to said upper end section; a pit prop reacting between said roof cap and said base; a pair of links connecting said lower end section to said second end section of said base; two pair of first pivot bearings in said lower end section and base, respectively, and a pair of second pivot bearings in each of said links and each adapted to pivotally cooperate with one of said pairs of first pivot bearings; and at least one auxiliary pivot bearing in each of said links and at least two auxiliary pivot bearings in at least one of said second and lower end sections, respectively, and adapted to cooperate with the auxiliary pivot bearings in said links.

2. A mine roof support as defined in claim 1, each of said two auxiliary pivot bearings being spaced from one of the pivot bearings of the pair in said base by a distance corresponding to the spacing between each of said one auxiliary pivot bearings in the respective link and one of the second pivot bearings in the same linke.

3. A mine roof support as defined in claim 1, wherein said links are plate members.

4. A mine roof support as defined in claim 1, wherein said links are triangular plate members.

5. A mine roof support as defined in claim 1, wherein said links are plate members and wherein each of said one auxiliary pivot bearings in a respective link and the pair of second pivot bearings in the same link are located at the corners of an imaginary triangle.

6. A mine roof support as defined in claim 2, wherein the spacing of each of said one auxiliary pivot bearings of the respective link from the second pivot bearings in the same link is in a ratio of about 4:3:5.

7. A mine roof support as defined in claim 1, wherein said two auxiliary pivot bearings are provided in said second end section and are spaced from the pair of first pivot bearings in said second end section in direction towards said first end section and said roof cap.

* * * * *